US008837260B2

(12) United States Patent
Zaugg

(10) Patent No.: US 8,837,260 B2
(45) Date of Patent: Sep. 16, 2014

(54) QUICK CORRECTION DEVICE FOR A DISPLAY SYSTEM

(71) Applicant: Alain Zaugg, Le Sentier (CH)

(72) Inventor: Alain Zaugg, Le Sentier (CH)

(73) Assignee: Montres Breguet S.A., L'abbaye (CH)

( * ) Notice: Subject to any disclaimer, the term of this patent is extended or adjusted under 35 U.S.C. 154(b) by 49 days.

(21) Appl. No.: 13/735,118

(22) Filed: Jan. 7, 2013

(65) Prior Publication Data

US 2013/0176827 A1 Jul. 11, 2013

(30) Foreign Application Priority Data

Jan. 10, 2012 (EP) ..... 12150548

(51) Int. Cl.

| | |
|---|---|
| ***G04B 19/26*** | (2006.01) |
| ***G04B 27/00*** | (2006.01) |
| ***G04B 47/00*** | (2006.01) |
| ***G04B 19/24*** | (2006.01) |
| ***G04B 47/06*** | (2006.01) |

(52) U.S. Cl.

CPC ..... *G04B 19/262* (2013.01); *G04B 19/24* (2013.01); *G04B 19/268* (2013.01); *G04B 27/001* (2013.01); *G04B 27/005* (2013.01); *G04B 47/06* (2013.01)

USPC ..... 368/10; 368/28; 368/34

(58) Field of Classification Search

USPC ..... 368/10, 11, 28, 34, 35, 37, 185, 190

See application file for complete search history.

(56) References Cited

U.S. PATENT DOCUMENTS

| | | | | | |
|---|---|---|---|---|---|
| 3,695,029 | A | * | 10/1972 | Tripet | 368/37 |
| 4,234,943 | A | * | 11/1980 | Teramoto et al. | 368/35 |
| 4,259,735 | A | | 3/1981 | Vuille | |
| 4,432,081 | A | * | 2/1984 | Schwartz et al. | 368/35 |
| 4,443,112 | A | | 4/1984 | Stotz et al. | |
| 7,139,224 | B2 | * | 11/2006 | Schneider | 368/28 |
| 2007/0109916 | A1 | * | 5/2007 | Bron | 368/35 |
| 2012/0243381 | A1 | | 9/2012 | Goeller et al. | |

FOREIGN PATENT DOCUMENTS

| | | |
|---|---|---|
| EP | 0 008 832 A2 | 3/1980 |
| FR | 2 463 435 A1 | 2/1981 |
| FR | 2 541 005 A1 | 8/1984 |

OTHER PUBLICATIONS

European Search Report issued Sep. 10, 2012, in European Patent Application No. 12150548.1, filed Jan. 10, 2012 (with English Translation).

* cited by examiner

*Primary Examiner* — Vit W Miska

(74) *Attorney, Agent, or Firm* — Oblon, Spivak, McClelland, Maier & Neustadt, L.L.P.

(57) ABSTRACT

The invention relates to a mechanism (5) comprising a measuring system (11, 13) mechanically connected to a display system (9) for displaying a time-related or other piece of information (2, 14). According to the invention, the display system (9) includes a quick correction device (10, 12) with an epicycloidal gear train for correcting said display of time-related or other information (2, 14) at any time while maintaining the relationship between the display system (9) and the measuring system (11, 13) during the correction phase. The invention particularly concerns the field of timepieces.

15 Claims, 3 Drawing Sheets

QUICK CORRECTION DEVICE FOR A DISPLAY SYSTEM

This application claims priority from European Patent Application No. 12150548.1 filed Jan. 10, 2012, the entire disclosure of which is incorporated herein by reference.

FIELD OF THE INVENTION

The invention relates to a timepiece comprising a display system and, more specifically, to a system of this type comprising a quick correction device.

BACKGROUND OF THE INVENTION

Display systems are widely used in horology. Mechanisms currently used for display are dragging, instantaneous or semi-instantaneous mechanisms. Current mechanisms may make it difficult to correct the display member, such as the calendar, in proximity to the change of the display member and require the use of a safety device to avoid damage. Moreover current correction devices may cause stress in the gear train when the display is corrected.

SUMMARY OF THE INVENTION

It is an object of the present invention to overcome all or part of the aforecited drawbacks by proposing a quick correction device which is totally integrated in the gear train of the display system and capable of correcting the display member at any time without generating stress in the gear train of the measuring system.

The invention therefore relates to a mechanism including a measuring system which is mechanically connected to a display system for displaying time-related or other information and including a quick correction device with an epicycloidal gear train which can correct said time-related or other information display at any time while maintaining the relationship between the display system and the measuring system during the correction phase, characterized in that the correction device includes an external planetary wheel connected at the outer toothing thereof to the measuring system train and at the inner toothing thereof to at least one satellite gear, in that said at least one satellite gear is permanently meshed between said external planetary wheel and an internal planetary wheel and is connected to the gear train of the display system and in that the internal planetary wheel is connected to a correction means so that the display system gear train is moved, via said at least one satellite gear, by the measuring system train or by the correction means without inducing stress in the measuring system train.

Advantageously according to the invention, it is clear that the correction device can thus correct the display at any time without inducing any stress in the gear train liable to interfere with the working of the measuring system. It is to be noted in particular that no problems arise in coupling the correction device to a rotating gear train. Finally, the correction device is advantageously very well integrated in the gear train, i.e. it is very compact.

In accordance with other advantageous features of the invention:

- the correction means includes a toothed wheel integral with the inner planetary wheel and driven in rotation by a correction finger;
- the correction means includes a jumper spring for locking the toothed wheel except during the correction phases;

- the correction finger and the jumper spring are integral with an elastically mounted pivoting part which moves the jumper spring away when the toothed wheel is being driven by the correction finger;
- said predetermined step is given by the number of teeth of the toothed wheel of the correction means;
- the type of display of time-related or other information is a hand or a disc;
- the display system displays at least one temperature value, or one altitude value or time value;
- the measuring system is a calendar system for displaying a calendar value and is connected to a time measuring system;
- said predetermined step is 12 hours or 24 hours;
- the display system displays at least one calendar value.

Moreover, the invention relates to a timepiece, characterized in that it includes a mechanism according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 2:
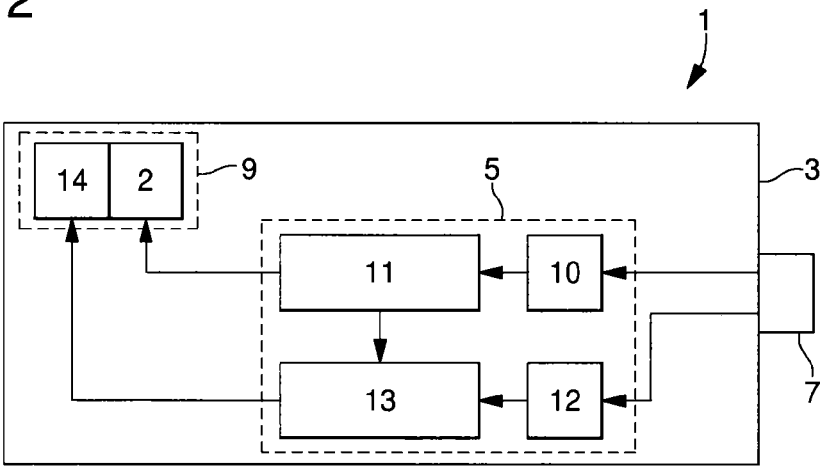
FIG. 2 is a function diagram of a mechanism according to the invention.

The example illustrated in FIG. 2 shows a schematic diagram of a mechanical part 1 according to the invention. The part includes a case 3 inside which there is mounted a mechanical mechanism 5 controlled by at least one control member 7, which preferably projects from case 3 and is for correcting the display device 9 of timepiece 1.

According to the invention, mechanism 5 including a measuring system 11, 13 is mechanically connected to a display system 9 for displaying a time-related or other piece of information 2, 14. Advantageously according to the invention, the display system 9 includes a quick correction device 10, 12 with an epicycloidal gear train for correcting said time-related or other information display 2, 14 at any time while maintaining the relationship between display system 9 and measuring system 11, 13 during the correction phase.

Figure 1:
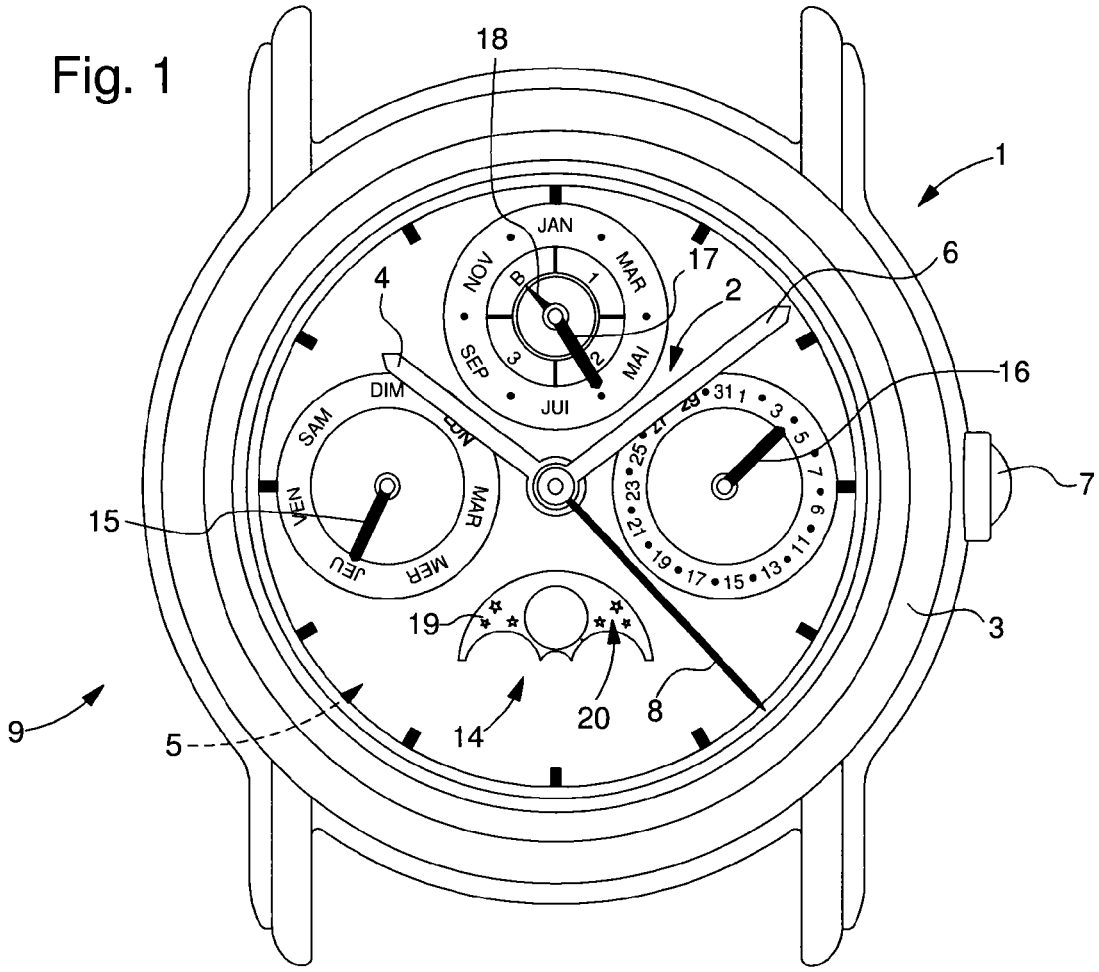
FIG. 1 is a diagram of a timepiece according to the invention.

By way of example, mechanism 5 may be a timepiece movement 5 which includes a time measuring system 11 for displaying the time and a calendar system 13 connected to time measuring system 11 for displaying a calendar value. Time measuring system 11 is for driving the moving parts of time display means 2. In the example illustrated in FIGS. 1 and 2, mechanical part 1 is a timepiece. Display device 9 of timepiece 1 includes a time display means 2 of the type with a moving hand 4, 6, 8 and hour circle. Time measuring system 11 also includes a correction device 10 allowing moving parts 4, 6 of display means 2 to be modified by actuating control member 7.

Calendar system 13 is for driving the moving parts of calendar display means 14. In the example illustrated in FIGS. 1 and 2, display device 9 of timepiece 1 includes a calendar display means 14 of the type with moving hands 15, 16, 17, 18 and/or disc 19 seen through an aperture 20. Calendar system 13 also includes a correction device 12 allowing said moving parts 15, 16, 17, 18, 19 of display means 14 to be modified, also by actuating control member 7 or by another dedicated correction member. Control member 7 thus preferably controls both correction devices 10 and 12 of timepiece movement 5.

Advantageously according to the invention, the calendar system 13 and/or time measuring system 11 can comprise display means 2, 14 of the dragging, instantaneous or semi-instantaneous type. In a non-limiting manner, calendar system 13 can display the day via a hand 15, the date via a hand 16, the month via a hand 17, the type of year (leap year or year 1, 2 or 3) via a hand 18 and the phase of the moon via a disc 19.

Moreover, calendar system 13 and/or time measuring system 11 preferably includes a correction device 10, 12 with an epicycloidal gear train, which is preferably integrated in their associated gear train 29, 21. The epicycloidal gear correction device 12 is explained below. However, it can perfectly well be applied to correction system 10 of time measuring system 11 or to another system for measuring time-related or other information.

Advantageously according to the invention, quick correction device 12 can modify display means 14, preferably in a predetermined step such as for example 12 or 24 hours, at any time of day, i.e. including around midnight, while maintaining the relationship of continuous movement relative to the movement of time during a correction operation.

Figure 3:
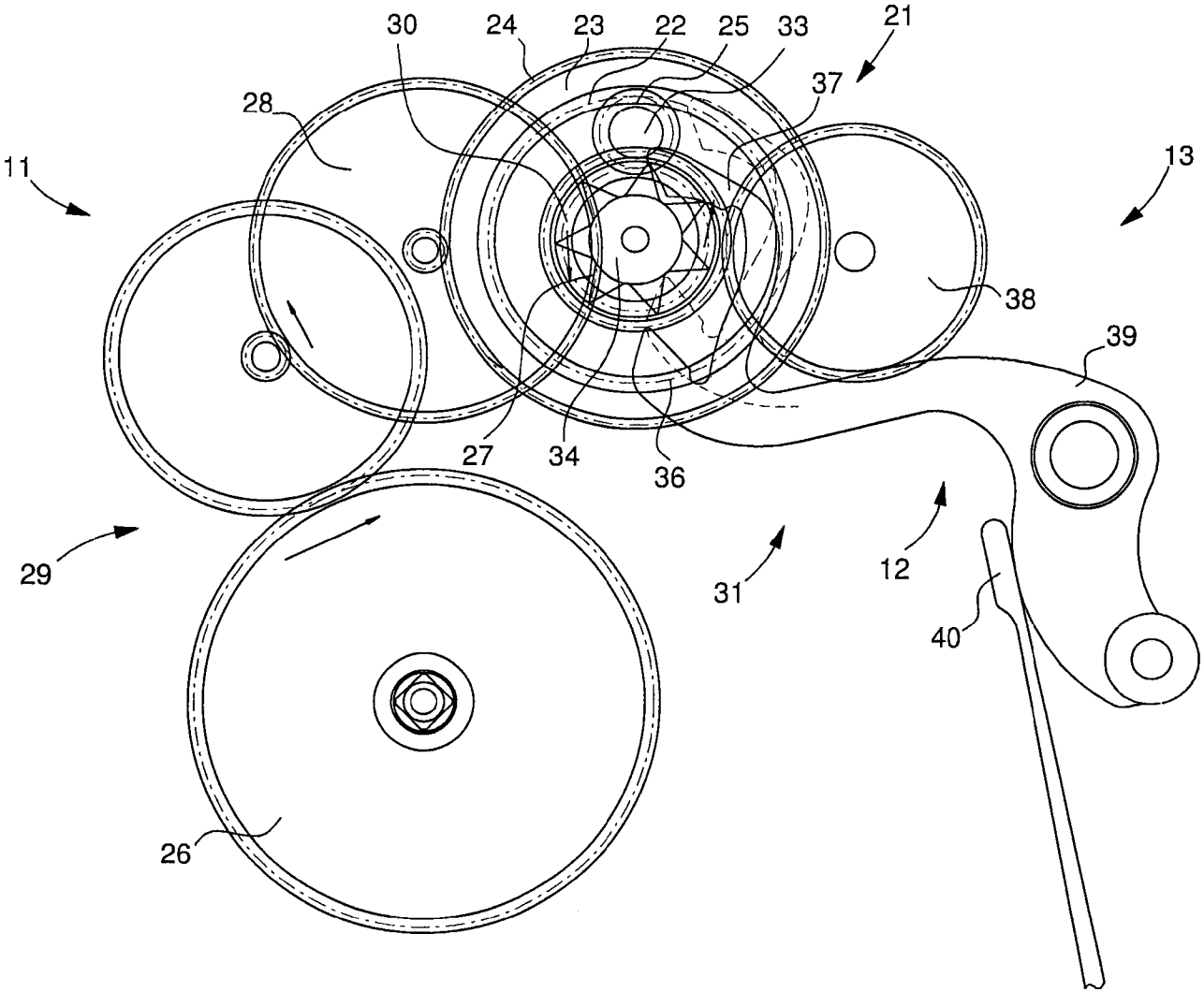
FIG. 3 is a top view of one part of a mechanism according to the invention.
Figure 4:
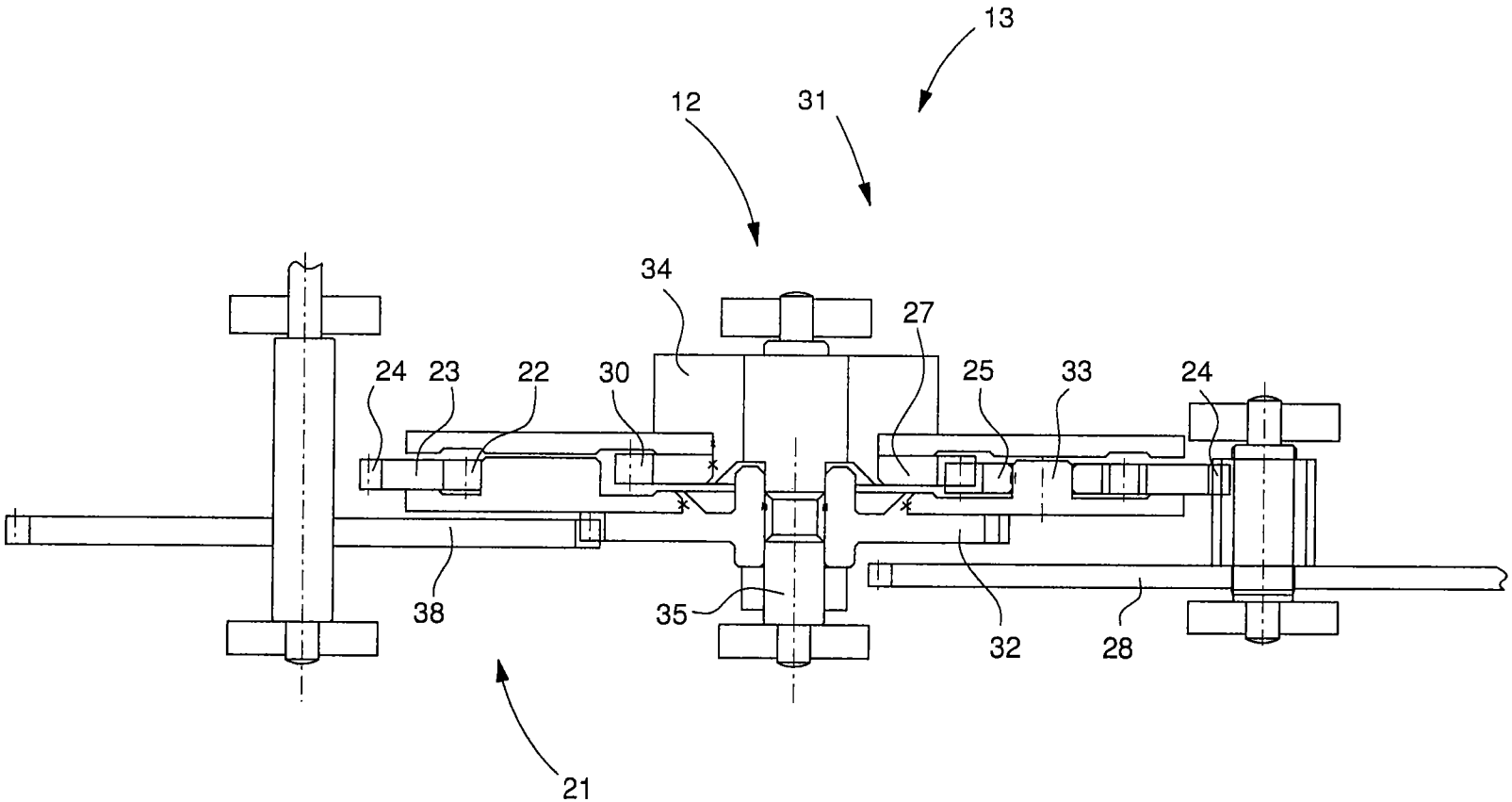
FIG. 4 is a cross-section of one part of a mechanism according to the invention.

In a non-limiting manner, a correction device 12 according to the invention is presented in FIGS. 3 and 4. It is thus clear that the example correction device 12 in FIGS. 3 and 4 which is applied to a moon phase display using a disc may also be applied respectively to the display of time-related or other information, with a different type of predetermined step and a different type of display member.

Preferably according to the invention, correction device 12 mainly includes an external planetary wheel 23, at least one satellite gear 25 and an internal planetary wheel 27. As seen in FIGS. 3 and 4, the external planetary wheel 23 is substantially annular and has an inner toothing 22 and an outer toothing 24. The outer toothing 24 is preferably connected to gear train 29 of time measuring system 11 and, incidentally to barrel 26, so as to synchronise the calendar system 13 with time measuring system 11. Preferably, external planetary wheel 23 is connected to the pinion of the hour wheel 28 of gear train 29.

The internal planetary wheel 27 includes an outer toothing 30 and is integral with correction means 31 of correction device 12. Said at least one satellite gear 25 is permanently meshed between inner toothing 22 of external planetary wheel 23 and outer toothing 30 of internal planetary wheel 27. By way of preference, correction device 12 includes three satellite gears 25 which are distributed at 120° from each other around internal planetary wheel 27. Finally, each satellite gear 25 is pivotally mounted on a satellite gear carrier 33 which is integral with a wheel set 32 of gear train 21 loosely mounted on arbour 35 of internal planetary wheel 27.

It is thus clear that, via at least one satellite gear 25, gear train 21 (via wheel set 32) of calendar system 13 can be moved either by gear train 29 of time measuring system 11 or by correction means 31 without inducing stress in said time measuring system gear train.

The correction means 31 includes a toothed wheel 34, or star wheel 34, integral with internal planetary wheel 27 and driven in rotation by a correction finger 36. Advantageously, the predetermined step of correction device 12 is given by the number of teeth of toothed wheel 34 of correction means 31. By way of example, in which wheel 38 drives the moon phase through one revolution in 29.5 days, toothed wheel 34 will preferably include 7 teeth in order to correct the calendar by a step equal to one day.

Moreover, correction means 31 further includes a jumper spring 37 for locking toothed wheel 34, or star wheel 34, except in the correction phases, i.e. when the correction finger 36 is not being used as illustrated in full lines in FIG. 3. Advantageously according to the invention, correction finger 36 and jumper spring 37 are integral with an elastically mounted pivoting part 39 so as to move jumper spring 37 away when toothed wheel 34 is being driven by correction finger 36, as illustrated in dashed lines in FIG. 3. FIG. 3 also shows that the strip spring 40 forces pivoting part 39 to pivot in the trigonometrical direction so that, except for during the correction phases, jumper spring 37 prevents the rotation of toothed wheel 34 and, incidentally, internal planetary wheel 27.

Consequently, except for during the correction phases, the outer toothing 30 of internal planetary wheel 27 plays the part of a fixed gear for said at least one satellite gear 25. It is therefore clear that the movement of gear train 29 of time measuring system 11 is transmitted to gear train 21 of calendar system 13, in succession, by external planetary wheel 23, said at least one satellite gear 25, then satellite gear carrier 33 which is integral with wheel set 32 of gear train 21.

Indeed, the trigonometrical rotation of the pinion of wheel 28 causes external planetary wheel 23 to pivot backwards. Since internal planetary wheel 27 is fixed except during the correction phases, the backward pivoting of external planetary wheel 23 forces said at least one satellite gear 25 to rotate in the same direction against stationary outer toothing 30 by moving satellite gear carrier 33 which is secured to wheel set 32.

Conversely, during the correction phases, inner toothing 22 of external planetary wheel 23 plays the part of a fixed gear for said at least one satellite gear 25. It is thus clear that the motion which actuates correction device 12 is transmitted to gear train 21 of calendar system 13, in succession, by control finger 36, toothed wheel 34, or star wheel 34, internal planetary wheel 23, said at least one satellite gear 25 and then satellite gear carrier 33, which is integral with wheel set 32 of gear train 21.

In fact, the backward rotation of pivoting part 39, against the force of strip spring 40, drives correction finger 36 in the same motion. During its motion, correction finger 36 encounters one tooth of toothed wheel 34 and forces the latter and internal planetary wheel 27, which is integral therewith, to rotate in the trigonometrical direction. Since the rotation of internal planetary wheel 27 is of much larger amplitude than the motion of wheel 28, external planetary wheel 23 consequently behaves like a fixed gear for said at least one satellite gear 25.

It is thus clear that the trigonometrical pivoting of internal planetary wheel 27 forces said at least one satellite gear 25 to rotate backwards against fixed inner toothing 22 by moving satellite gear carrier 33, which is integral with wheel set 32. Thus, depending on the number of teeth of toothed wheel 34 or star wheel 34, each actuation of pivoting part 39 thus corrects display 14 by a predetermined step, i.e. for example by a 12 or 24 hours step.

Advantageously according to the invention, it is clear that correction device 10, 12 can thus correct display 2, 14 at any time without inducing any stress in gear train 21, 29 liable to interfere with the operation of the measuring system. It is to be noted in particular that no problems arise in coupling the correction device to a rotating gear train. Finally, the correction device 10, 12 is advantageously very well integrated in gear train 21, 29, i.e. it is very compact.

Of course, this invention is not limited to the illustrated example but is capable of various variants and alterations that will appear to those skilled in the art. In particular, the geometries and/or dimensions of correction device 12 may be adapted according to the application, i.e. the value to be displayed or the space requirement to be observed. Indeed, the invention should not be limited to the application of a timepiece. Thus, mechanical part 1 may be a mechanical altimeter or a mechanical thermometer with or without a time measuring system and/or calendar.

It is also possible to envisage replacing correction by jumps using the star wheel 34—star wheel 37 assembly with a continuously rotating correction system on a friction element.

Finally, as explained above, measuring system 11, 13 should not be limited to a system displaying time information 2, 14. Thus, by way of example, advantageously according to the invention, the correction device 10, 12 explained above may also be applied to a measuring system displaying non time-related data such as altitude, i.e. underwater depth or height above water, or even temperature.

What is claimed is:

1. A mechanism comprising a measuring system mechanically connected to a display system for displaying time-related or other information and comprising a quick correction device with an epicycloidal gear train which can correct said display of time-related or other information at any time and by a predetermined step while maintaining the relationship between the display system and the measuring system during a correction phase, wherein the correction device includes an external planetary wheel connected at outer toothing thereof to the gear train of the measuring system and at inner toothing thereof to at least one satellite gear, wherein said at least one satellite gear is permanently meshed between said external planetary wheel and an internal planetary wheel and is connected to the gear train of the display system, and wherein the internal planetary wheel is connected to a correction means so that, via said at least one satellite gear, the gear train of the display system is moved by the gear train of the measuring system or by the correction means without inducing stress in the gear train of the measuring system.

2. The mechanism according to claim 1, wherein the correction means includes a toothed wheel integral with the internal planetary wheel and driven in rotation by a correction finger.

3. The mechanism according to claim 2, wherein the correction means includes a jumper spring for locking the toothed wheel except during the correction phase.

4. The mechanism according to claim 3, wherein the correction finger and the jumper spring are integral with an elastically mounted pivoting part so as to move the jumper spring away when the toothed wheel is being driven by the correction finger.

5. The mechanism according to claim 2, wherein said predetermined step is given by the number of teeth of the toothed wheel of the correction means.

6. The mechanism according to claim 1, wherein the display of time-related or other information is of the type with a hand.

7. The mechanism according to claim 1, wherein the display of time-related or other information is of the type with a disc.

8. The mechanism according to claim 1, wherein the display system displays at least one temperature value.

9. The mechanism according to claim 1, wherein the display system displays at least one altitude value.

10. The mechanism according to claim 1, wherein the display system displays at least one time value.

11. The mechanism according to claim 10, wherein said predetermined step is 12 hours.

12. The mechanism according to claim 10, wherein said predetermined step is 24 hours.

13. The mechanism according to claim 1, wherein the measuring system is a calendar system for displaying a calendar value and which is connected to a time measuring system.

14. The mechanism according to claim 13, wherein the display system displays at least one calendar value.

15. A timepiece wherein the timepiece includes a mechanism according to claim 1.

* * * * *

UNITED STATES PATENT AND TRADEMARK OFFICE

CERTIFICATE OF CORRECTION

PATENT NO. : 8,837,260 B2
APPLICATION NO. : 13/735118
DATED : September 16, 2014
INVENTOR(S) : Alain Zaugg It is certified that error appears in the above-identified patent and that said Letters Patent is hereby corrected as shown below:

On the title page, Item (71) information is incorrect. Item (71) should read:

-- (71) Applicant: Montres Breguet S.A., L'abbaye (CH) --

Signed and Sealed this
Sixteenth Day of December, 2014

Michelle K. Lee

Michelle K. Lee
*Deputy Director of the United States Patent and Trademark Office*